US008985425B2

(12) United States Patent
Osuga et al.

(10) Patent No.: US 8,985,425 B2
(45) Date of Patent: Mar. 24, 2015

(54) FLUID SUPPLY CONTROL DEVICE AND GAS COMBUSTION TYPE NAILER

(75) Inventors: Satoshi Osuga, Tokyo (JP); Yasushi Yokochi, Tokyo (JP); Hisami Oguri, Tokyo (JP)

(73) Assignee: Max Co., Ltd., Tokyo (JP)

( * ) Notice: Subject to any disclaimer, the term of this patent is extended or adjusted under 35 U.S.C. 154(b) by 746 days.

(21) Appl. No.: 13/189,877

(22) Filed: Jul. 25, 2011

(65) Prior Publication Data

US 2012/0018485 A1 Jan. 26, 2012

(30) Foreign Application Priority Data

Jul. 26, 2010 (JP) ..... 2010-167136

(51) Int. Cl.
*B25C 1/08* (2006.01)

(52) U.S. Cl.
CPC ..... *B25C 1/08* (2013.01)
USPC ..... 227/9; 251/129.01

(58) Field of Classification Search
USPC ..... 251/129.01; 227/10, 11; 123/46 SC
See application file for complete search history.

(56) References Cited

U.S. PATENT DOCUMENTS

| | | | | |
|---|---|---|---|---|
| 5,263,439 | A * | 11/1993 | Doherty et al. | 123/46 SC |
| 6,182,942 | B1 * | 2/2001 | Kadlicko | 251/129.1 |
| 8,544,710 | B2 * | 10/2013 | Tanaka | 227/10 |
| 2005/0098752 | A1 * | 5/2005 | Burrola et al. | 251/129.15 |

FOREIGN PATENT DOCUMENTS

| | | | | |
|---|---|---|---|---|
| CN | 101657299 | A | 2/2010 | |
| CN | 101687314 | A | 3/2010 | |
| EP | 2 202 033 | A1 | 6/2010 | |
| EP | 2202033 | A1 * | 6/2010 | ..... B25C 1/08 |
| JP | 51 120526 | U | 9/1976 | |
| JP | 2-46174 | U | 3/1990 | |
| JP | 2956004 | | 7/1999 | |
| JP | 3063983 | | 5/2000 | |
| JP | 3149527 | | 3/2009 | |
| JP | 3149527 | U * | 4/2009 | |

* cited by examiner

*Primary Examiner* — Andrew M Tecco
(74) *Attorney, Agent, or Firm* — Drinker Biddle & Reath LLP

(57) ABSTRACT

A fluid supply control device and a gas combustion type nailer including the fluid supply control device are provided. The fluid supply control device includes a gauging chamber configured to be charged with a fluid, an inlet port through which the fluid flows into the gauging chamber, an outlet port through which the fluid flows out from the gauging chamber, a first valve element arranged inside the gauging chamber to close the inlet port, a second valve element arranged inside the gauging chamber to close the outlet port, an electromagnetic biasing structure configured to electromagnetically bias the first valve element and the second valve element, and an elastic biasing structure configured to elastically bias at least one of the first valve element and the second valve element. The first valve element and the second valve element are independently movable and are actuated with a time difference.

13 Claims, 10 Drawing Sheets

FLUID SUPPLY CONTROL DEVICE AND GAS COMBUSTION TYPE NAILER

CROSS-REFERENCE TO RELATED APPLICATION(S)

The present application claims the benefit of priority of Japanese Patent Application No. 2010-167136, filed on Jul. 26, 2010, the disclosure of which is incorporated herein by reference.

TECHNICAL FIELD

The present invention relates to a fluid supply control device and a gas combustion type nailer including the fluid supply control device.

BACKGROUND

A gas combustion type nailer is configured to send gas fuel from a fuel gas can to a cylinder of a striking mechanism and to ignite and combust the gas fuel, thereby driving a piston inside the cylinder by a combustion pressure to strike a fastener such as a nail (see, e.g., Japanese Patent No. 2956004 B2). To send the gas fuel to the cylinder with a constant amount per strike, a gauging chamber is connected to an ejection nozzle of the fuel gas can. A certain amount of gas fuel from the fuel gas can is charged in the gauging chamber, is sent to the cylinder via a solenoid valve. The solenoid valve is arranged between an inlet and an outlet of the gauging chamber, i.e., between the inlet through which the gas fuel is introduced from the fuel gas can and the outlet from which the gas fuel is supplied to the cylinder. When the solenoid valve opens the outlet of the gauging chamber, the fuel gas inside the gauging chamber is sent to the cylinder. When the solenoid valve closes the outlet of the gauging chamber, the certain amount of fuel gas is charged in the gauging chamber from the inlet.

Also in other related art, a fluid supply control device using a solenoid valve is configured in a similar manner (see, e.g., Japanese Patent No. 3063983 B2).

According to the fluid supply control device described above, when the solenoid valve closes the outlet of the gauging chamber, a certain amount of fluid is charged in the gauging chamber. However, when the solenoid valve opens the outlet of the gauging chamber, the fluid in the gauging chamber is discharged from the outlet, and at the same time, a subsequent fluid flows into the gauging chamber from the inlet. Therefore, the fluid is supplied slightly more than the certain amount. This error is related to a driving speed of the solenoid valve and a flow velocity of the fluid. The flow velocity is related to the pressure and viscosity of the fluid. For example, a temperature change causes a change in vaporization pressure of the fuel gas, and accordingly, a change in the flow velocity of the fuel gas. Further, the driving speed of the solenoid valve is influenced by the flow velocity of the fuel gas, and is not always the same. Therefore, for example, in the gas combustion type nailer described above, striking force of the gas combustion type nailer becomes unstable.

SUMMARY

Illustrative aspects of the present invention provide a fluid supply control device capable of supplying an accurate amount of fluid and a gas combustion type nailer including the fluid supply control device.

According to an illustrative aspect of the present invention, a fluid supply control device is provided. The fluid supply control device includes a gauging chamber configured to be charged with a fluid from a fluid supply source, an inlet port through which the fluid flows into the gauging chamber, an outlet port through which the fluid flows out from the gauging chamber, a first valve element arranged inside the gauging chamber to close the inlet port, a second valve element arranged inside the gauging chamber to close the outlet port, an electromagnetic biasing structure configured to electromagnetically bias the first valve element and the second valve element, and an elastic biasing structure configured to elastically bias at least one of the first valve element and the second valve element. The first valve element and the second valve element are configured and arranged such that the first valve element and the second valve element are independently movable and are actuated with a time difference.

According to another illustrative aspect of the present invention, a gas combustion type nailer is provided. The gas combustion type nailer includes the fluid supply control device described above, a combustion chamber to which fuel gas from a fuel gas can is supplied through the fluid supply control device, and a striking mechanism driven by a combustion of the fuel gas in the combustion chamber.

Other aspects and advantages of the present invention will be apparent from the following description, the drawings, and the claims.

DETAILED DESCRIPTION

Figure 1A:
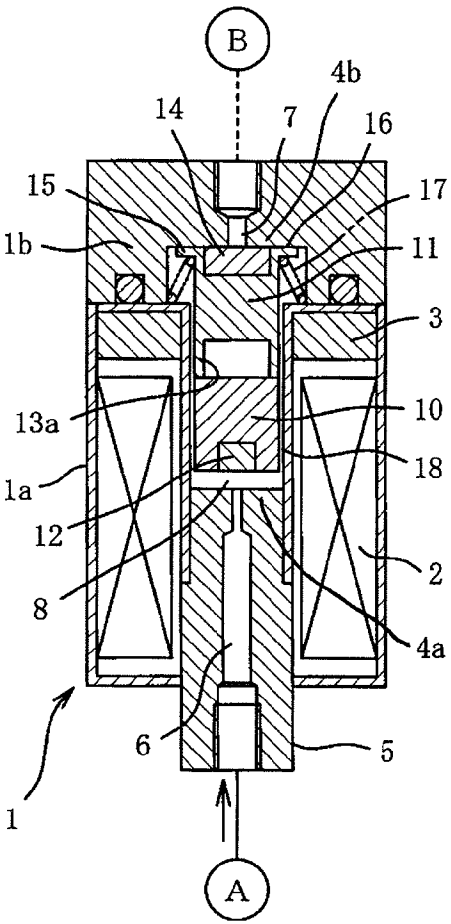
FIG. 1A is a longitudinal sectional view of a fluid supply control device according to an exemplary embodiment of the present invention, illustrating a standby condition of the fluid supply control device.

FIG. 1A is a longitudinal sectional view of a fluid supply control device according to an exemplary embodiment of the present invention. A fluid is not particularly limited, and for example, a liquid is suitable.

The fluid supply control device is arranged on a passage between a fluid supply source A and a supply target B. A device body 1 includes a hollow coil receiving part 1*a* and a metallic valve seat block 1*b* covering an upper opening of the coil receiving part 1*a*. An electromagnetic coil 2 (an example of an electromagnetic biasing structure) is accommodated in the receiving unit 1*a*, and a magnetic body 3 is disposed above the electromagnetic coil 2. A core 5 is provided in a lower region of a hollow portion of the device body 1. The core 5 has a first valve seat 4*a*, and an inlet port 6 is formed inside the first valve seat 4*a*. The valve seat block 1*b* has a second valve seat 4*b*, and an outlet port 7 is formed at the center of the second valve seat 4*b*. A cylindrical gauging chamber 8 is formed between the inlet port 6 and the outlet port 7. In the gauging chamber 8, a first valve element 10 and a second valve element 11 are arranged so as to be slidable in a vertical direction, such that the first valve element 10 opens and closes the inlet port 6, and the second valve element 11 opens and closes the outlet port 7. An inflow pressure from the fluid supply source is constantly applied to the inlet port 6.

The first valve element 10 and the second valve element 11 are made of iron (a soft magnetic body) and both are biased to move down by electromagnetic force when the electromagnetic coil 2 is excited. A seal member 12 is provided at the center of the lower end of the first valve element 10 to close an opening end of the inlet port 6. An annular spacer 13*a* is formed on the lower end of the second valve element 11. A seal member 14 is provided at the center of the upper end of the second valve element 11. Further, a flange 15 is formed along a circumference of the upper end of the second valve element 11. An annular recess 16 is formed in the valve seat block 1*b* at a position corresponding to the upper portion of the second valve element 11, and a spring 17 (an example of an elastic biasing structure) is arranged in the recess 16. The upper end of the spring 17 is coupled to the flange 15 of the second valve element 11, and as a result, the second valve element 11 is constantly biased toward its top dead point.

The first valve element 10 receives the inflow pressure of the fluid to open the inlet port 6. The second valve element 11 receives the spring force of the spring 17 and the inflow pressure to close the outlet port 7. By the electromagnetic force of the electromagnetic coil 2, the first valve element 10 is biased in a direction to close the inlet port 6 against the inflow pressure, and the second valve element 11 is biased in a direction to open the outlet port 7 against the spring force and the inflow pressure.

The spring force of the spring 17 is smaller than the electromagnetic force of the electromagnetic coil 2.

Inside the gauging chamber 8, a certain amount of fluid is charged in a space other than the first valve element 10 and the second valve element 11. The gauging chamber 8 includes the recess 16. Outer diameters of the first valve element 10 and the second valve element 11 are smaller than an inner diameter of the gauging chamber 8, whereby a gap 18 is formed to allow the fluid to flow from the inlet port to the outlet port.

The first valve element 10 and the second valve element 11 are actuated with a time difference by the electromagnetic force of the electromagnetic coil, the spring force, and the inflow pressure of the fluid from the fluid supply source. For example, the first valve element 10 closes the inlet port 6, and thereafter, the second valve element 11 opens the outlet port 7. The second valve element 11 closes the outlet port 7, and thereafter, the first valve element 10 opens the inlet port 6. A distance between the first valve element 10 and the electromagnetic coil 2 is different from a distance between the second valve element 11 and the electromagnetic coil 2. The first valve element 10 is placed between the second valve element 11 and the core 5, and placed closer to the electromagnetic coil 2 than the second valve element 11. Moreover, the second valve element 11 is biased upward by the spring 17. As a result, the electromagnetic force of the electromagnetic coil 2 that acts on the first valve element 10 is stronger than the electromagnetic force of the electromagnetic coil 2 that acts on the second valve element 11. Therefore, when the electromagnetic coil 2 is energized, the first valve element 10 on which the strong magnetic action acts is actuated to close the inlet port 6, and thereafter, the second valve element 11 is actuated to open the outlet port 7. When current to the electromagnetic coil 2 is shut off, the second valve element 11 closes the outlet port 7, and thereafter, the first valve element 10 opens the inlet port 6, by the spring force of the spring 17 and the inflow pressure of the fluid.

The spacer 13*a* of the second valve element 11 is made of a nonmagnetic material. Since a space is formed between the first valve element 10 and the second valve element 11 by the spacer 13*a*, the first valve element 10 is placed closer to the electromagnetic coil 2 than the second valve element 11.

According to the above configuration, in the standby condition, the first valve element 10 opens the inlet port 6 and the second valve element 11 closes the outlet port 7, as shown in FIG. 1A. Therefore, the fluid from the fluid supply source A is sent into the gauging chamber 8 from the inlet port 6 at a constant pressure. Since the outlet port 7 is closed, a certain amount of fluid is charged in the gauging chamber 8.

Figure 1B:
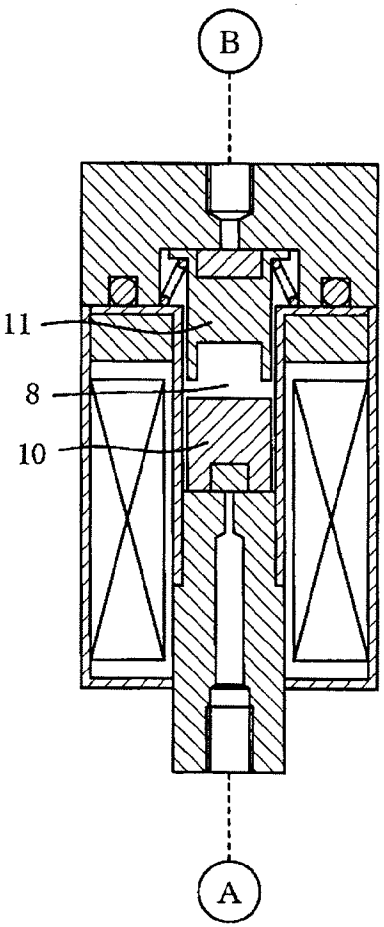
FIG. 1B is another longitudinal sectional view of the fluid supply control device of FIG. 1A, illustrating the fluid supply control device in operation.
Figure 1C:
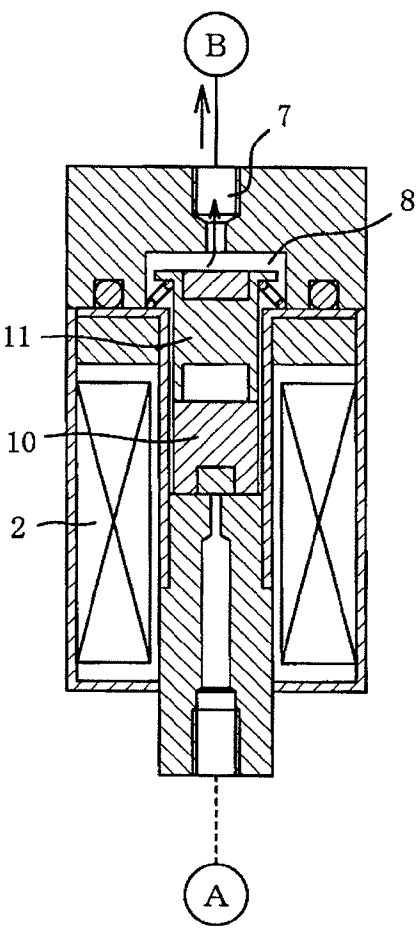
FIG. 1C is yet another longitudinal sectional view of the fluid supply control device of FIG. 1A, illustrating the fluid supply control device supplying a fluid.

To supply the fluid to the supply target B, the electromagnetic coil 2 is energized. By the electromagnetic force of the electromagnetic coil 2, the first valve element 10 is actuated downward to close the inlet port 6 as shown in FIG. 1B, and thereafter, the second valve element 11 is actuated downward against the spring force of the spring 17 to open the outlet port 7, as shown in FIG. 1C. When the first valve element 10 closes the inlet port 6, the inflow of the fluid into the gauging chamber 8 through the inlet port 6 is stopped. Thereafter, when the second valve element 11 opens the outlet port 7, the second valve element 11 lands on the upper end of the first valve element 10. The fluid in the gauging chamber 8 moves upward through the longitudinal groove 18, and is sent out from the outlet port 7 in a vaporized state. Accordingly, when the outlet port 7 is opened, the first valve element 10 closes the inlet port 6, and as a result, the fluid from the fluid supply source A does not flow into the gauging chamber 8. Therefore, the fluid charged in the gauging chamber 8 is accurately supplied to the supply target B with a certain amount.

When the supply of current to the electromagnetic coil 2 is shut off, the second valve element 11 is actuated by the spring 17 to close the outlet port 7, as shown in FIG. 1A. Thereafter, since the first valve element 10 moves upward by the inflow pressure from the fluid supply source A, the inlet port 6 is opened and the fluid is supplied into the gauging chamber 8 from the inlet port 6. A certain amount of fluid is charged in the gauging chamber 8, and a next supply actuation is prepared.

As described above, the difference in intensity of the electromagnetic forces of the electromagnetic coil 2 with respect to the first valve element 10 and the second valve element 11 is caused by a difference in distances from the electromagnetic coil 2 to the first valve element 10 and the second valve element 11. By forming the space between the first valve element 10 and the second valve element 11, the second valve element 11 is placed further away from the electromagnetic coil 2 than the first valve element 10. Accordingly, since the distances from the electromagnetic coil 2 to the first valve element 10 and the second valve element 11 are different from each other, the first valve element 10 receives the magnetic action of the electromagnetic coil 2 more strongly than the second valve element 11 when the electromagnetic coil 2 is energized. Therefore, the first valve element 10 and the second valve element 11 are actuated with a time difference, such that the first valve element 10 is first actuated to close the inlet port 6 to create an airtight condition of the gauging chamber 8, and thereafter, the second valve element 11 is actuated to open the outlet port 7. Therefore, while the fluid in the gauging chamber 8 is discharged from the outlet port 7, the fluid does not flow into the gauging chamber 8 from the inlet port 6. That is, only the fluid inside the gauging chamber 8 is discharged toward the supply target B. When the energization is shut off, the second valve element 11 is first actuated by the force of the spring 17 to close the outlet port 7 and thereafter, the first valve element 10 is actuated to open the inlet port 6. As a result, a certain amount of fluid is charged in the gauging chamber 8, whereby a next supply actuation is prepared and the fluid supply control device is in a standby condition.

Accordingly, the first valve element 10 and the second valve element 11 are sequentially actuated. As a result, a certain amount of fluid is charged in the gauging chamber 8 and only the charged fluid is supplied from the outlet port 7 of the gauging chamber 8 to the supply target B. Therefore, an accurate amount of fluid can always be supplied to the supply target B.

Figure 2A:
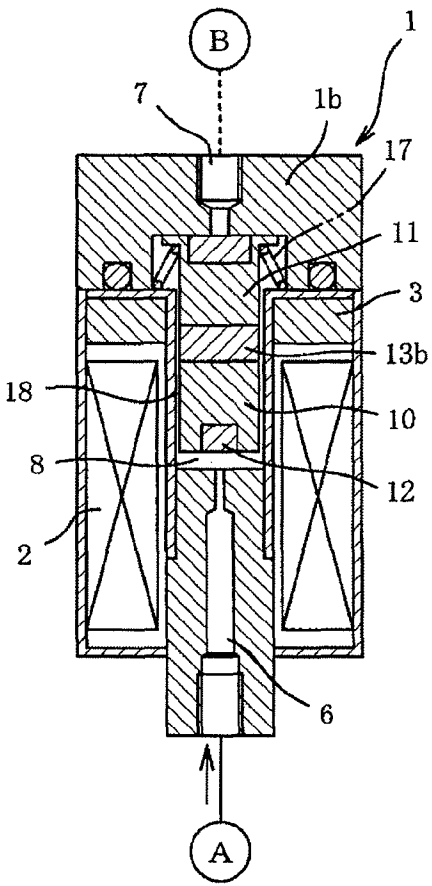
FIG. 2A is a longitudinal sectional view of a fluid supply control device according to another exemplary embodiment of the present invention, illustrating a standby condition of the fluid supply control device.
Figure 2B:
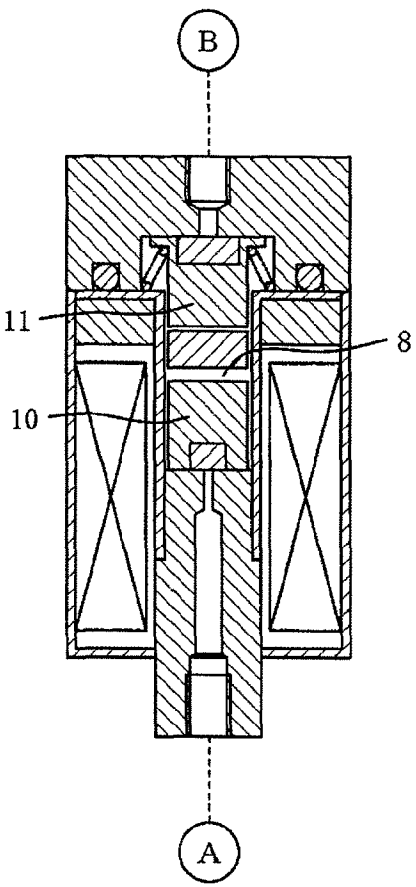
FIG. 2B is another longitudinal sectional view of the fluid supply control device of FIG. 2A, illustrating the fluid supply control device in operation.
Figure 2C:
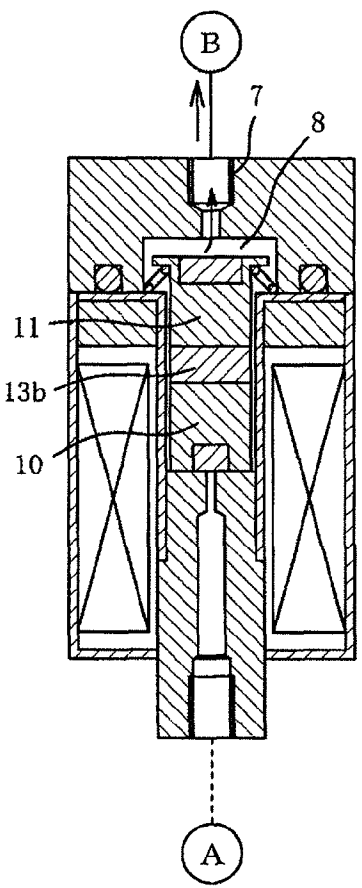
FIG. 2C is yet another longitudinal sectional view of the fluid supply control device of FIG. 2A, illustrating the fluid supply control device supplying a fluid.

The spacer causing the difference in the distance to the electromagnetic coil 2 is not limited to the annular spacer 13*a*. For example, as shown in FIG. 2A, an intermediate member 13*b* made of an electrically insulating material may be provided between the first valve element 10 and the second valve element 11. Also by this configuration, when the electromagnetic coil 2 is energized from the standby condition, the first valve element 10 receives the magnetic action of the electromagnetic coil 2 more strongly than the second valve element 11, and as a result, the first valve element 10 and the second valve element 11 are actuated with a time difference. That is, the first valve element 10 is first actuated to close the inlet port 6, and thereafter, the second valve element 11 is actuated to open the outlet port 7, as shown in FIGS. 2B and 2C. Therefore, while the fluid in the gauging chamber 8 is discharged from the outlet port 7, the fluid does not flow into the gauging chamber 8 from the inlet port 6, and only the fluid in the gauging chamber 8 is discharged. When the energization is shut off, the second valve element 11 is first actuated by the force of the spring 17 to close the outlet port 7, and thereafter, the first valve element 10 opens the inlet port 6, as shown in FIG. 2A. As a result, a certain amount of fluid is charged in the gauging chamber 8, whereby a next supply actuation is prepared and the fluid supply control device is in a standby condition.

In FIG. 2A, the same reference numerals refer to the same elements as FIG. 1A. This similarly applies to the figures following FIG. 3A.

Figure 3A:
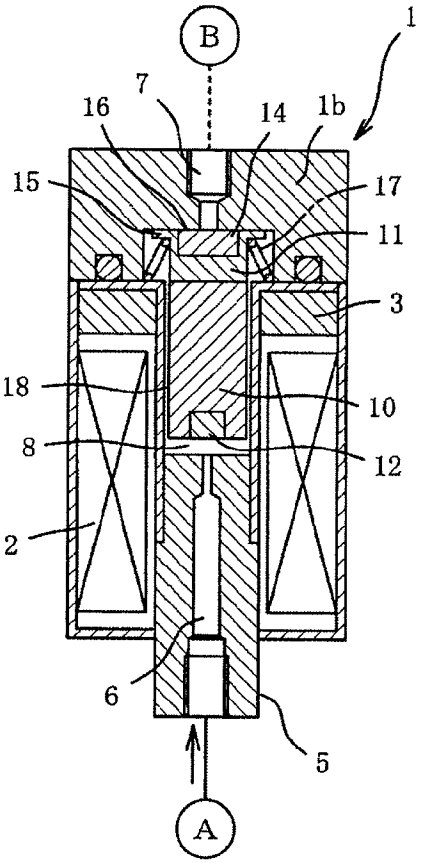
FIG. 3A is a longitudinal sectional view of a fluid supply control device according to another exemplary embodiment of the present invention, illustrating a standby condition of the fluid supply control device.

The difference in distances to the electromagnetic coil 2 between the first valve element 10 and the second valve element 11 may be achieved by making the length of the first valve element 10 to be longer than the length of the second valve element 11, as shown in FIG. 3A.

Figure 3B:
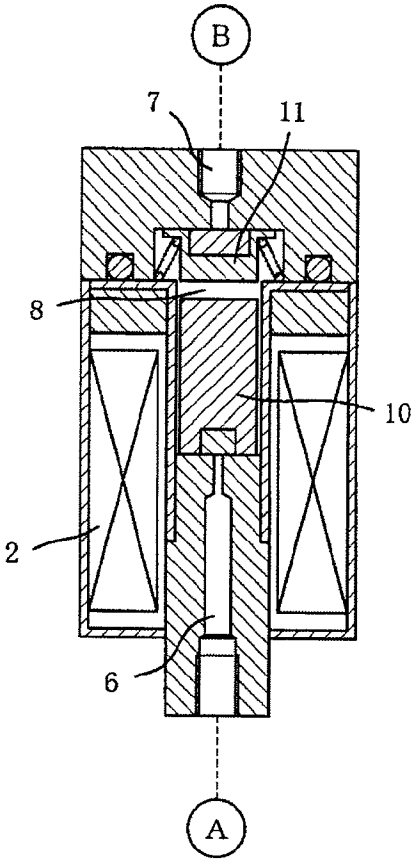
FIG. 3B is another longitudinal sectional view of the fluid supply control device of FIG. 3A, illustrating the fluid supply control device in operation.
Figure 3C:
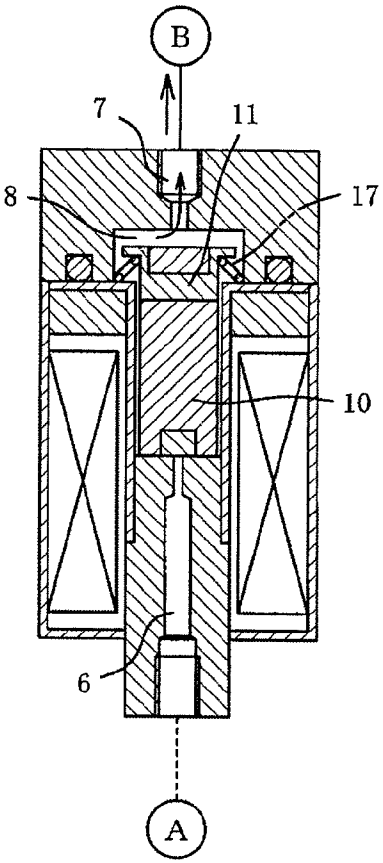
FIG. 3C is yet another longitudinal sectional view of the fluid supply control device of FIG. 3A, illustrating the fluid supply control device supplying a fluid.

Also in this case, when the electromagnetic coil 2 is energized from the standby condition, the first valve element 10 receives the magnetic action of the electromagnetic coil 2 more strongly than the second valve element 11, and as a result, the first valve element 10 and the second valve element 11 are actuated with a time difference. That is, the first valve element 10 is first actuated to close the inlet port 6 and thereafter, the second valve element 11 is actuated to open the outlet port 7, as shown in FIGS. 3B and 3C. Therefore, while the fluid in the gauging chamber 8 is discharged, no fluid flows into the gauging chamber 8 from the inlet port 6, that is, only the fluid inside the gauging chamber 8 is discharged. When the energization is shut off, the second valve element 11 is first actuated by the force of the spring 17 to close the outlet port 7, and thereafter, the first valve element 10 is actuated to open the inlet port 6, as shown in FIG. 3A. As a result, a certain amount of fluid is charged in the gauging chamber 8, whereby a next supply actuation is prepared and the fluid supply control device is in a standby condition.

The difference in intensity of the magnetic action of the electromagnetic coil 2 on the first valve element 10 and the second valve element 11 may also be achieved by other means.

For example, a magnetic property of the first valve element 10 may be different from a magnetic property of the second valve element 11. Specifically, the first valve element 10 and the second valve element 11 may be formed by using materials having different magnetic permeability. In an example shown in FIG. 4A, the first valve element 10 is made of a material having high magnetic permeability (e.g., stainless steel) and the second valve element 11 is made of a material having low magnetic permeability (e.g., stainless steel).

Figure 4C:
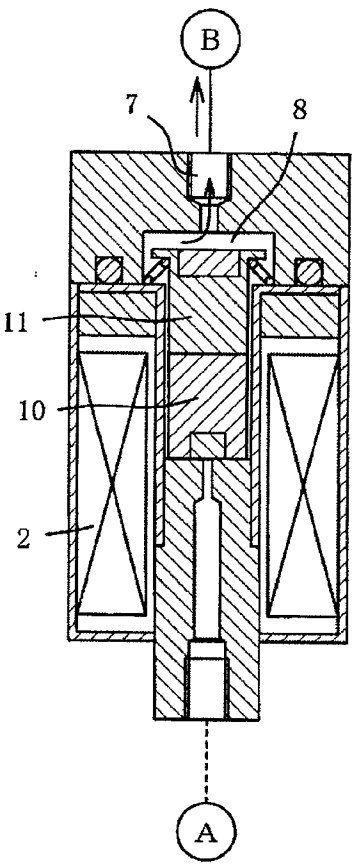
FIG. 4C is yet another longitudinal sectional view of the fluid supply control device of FIG. 4A, illustrating the fluid supply control device supplying a fluid.
Figure 4B:
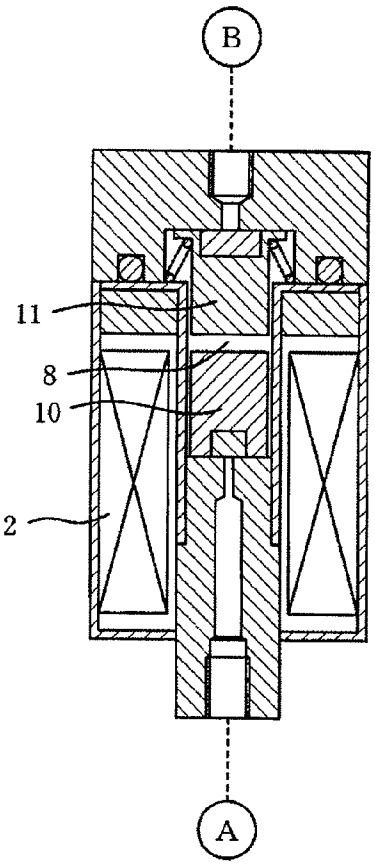
FIG. 4B is another longitudinal sectional view of the fluid supply control device of FIG. 4A, illustrating the fluid supply control device in operation.

According to the above configuration, to supply the fluid to the supply target B, the electromagnetic coil 2 is energized. As shown in FIG. 4B, first, the first valve element 10 having high magnetic permeability moves downward to close the inlet port 6 and stops the flowing in of the fluid into the gauging chamber 8. Thereafter, when the second valve element 11 moves downward against the spring 17 to open the outlet port 7, the second valve element 11 lands on the upper end of the first valve element 10, as shown in FIG. 4C. The fluid in the gauging chamber 8 moves upward and is sent out from the outlet port 7. Accordingly, while the outlet port 7 is opened, the first valve element 10 closes the inlet port 6, and as a result, the fluid does not flow into the gauging chamber 8 from the fluid supply source A. Therefore, the fluid charged in the gauging chamber 8 is accurately supplied to the supply target B with a certain amount.

Figure 4A:
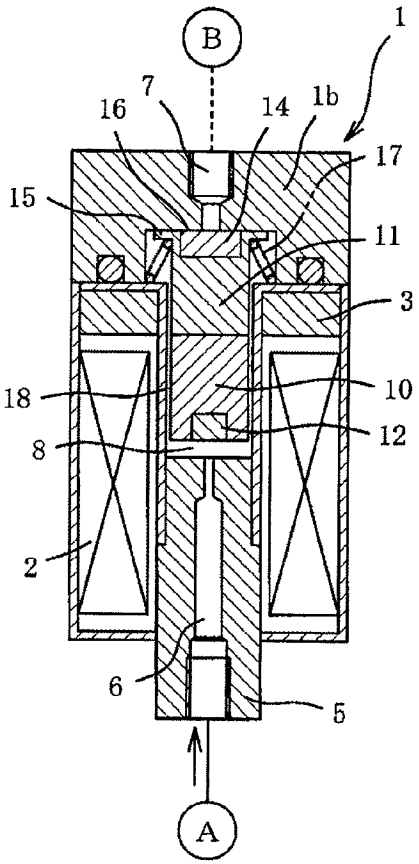
FIG. 4A is a longitudinal sectional view of a fluid supply control device according to another exemplary embodiment of the present invention, illustrating a standby condition of the fluid supply control device.

When the supply of current to the electromagnetic coil 2 is shut off, the second valve element 11 is actuated by the spring 17 to close the outlet port 7, as shown in FIG. 4A. Thereafter, since the first valve element 10 moves upward by the inflow pressure from the fluid supply source A, the inlet port 6 is opened and the fluid from fluid supply source A is supplied into the gauging chamber 8 through the inlet port 6. A certain amount of fluid is charged in the gauging chamber 8 and a next supply actuation is thus prepared.

According to the exemplary embodiments described above, the time difference actuation of first valve element 10 and second valve element 11 can be achieved with a simple structure and low cost.

The time difference actuation of the first valve element 10 and the second valve element 11 is not limited to the time difference actuation by the difference in intensity of the magnetic action of the electromagnetic coil 2 on the first valve element 10 and the second valve element 11. For example, the time difference actuation of the first valve element 10 and the second valve element 11 may be achieved by a difference between a spring load (spring force) to the first valve element 10 and a spring load to the second valve element 11.

Figure 5A:
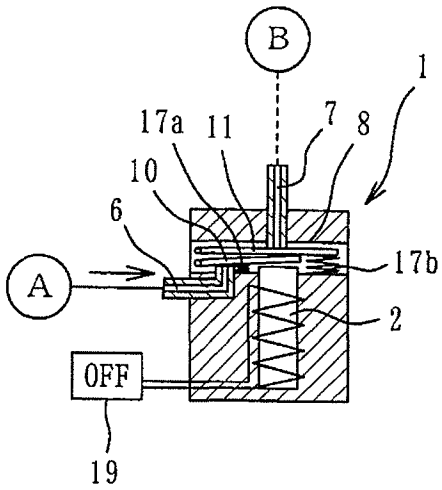
FIG. 5A is a longitudinal sectional view of a fluid supply control device according to another exemplary embodiment of the present invention, illustrating a standby condition of the fluid supply control device.

For example, as shown in FIG. 5A, the electromagnetic coil 2 is connected to a power supply device 19, and the first valve element 10 and the second valve element 11, each having a plate shape and made of magnetic material, are arranged above the electromagnetic coil 2 is a vertically movable manner. One end of the first valve element 10 is pivotably supported on the device body 1 and the other end of the first valve element 10 is biased upward by a first spring 17*a*. One end of the second valve element 11 is pivotably supported on the device body 1 and the other end of the second valve element 11 is biased upward by a second spring 17*b*. The spring force of the first spring 17*a* is smaller than that of the second spring 17*b*. The outlet port 7 is formed in the upper part of the device body 1 and the inlet port 6 is formed on the lateral side of the device body 1. The first valve element 10 moves upward to open the inlet port 6 and moves downward to close the inlet port 6. The second valve element 11 moves upward to close the outlet port 7 and moves downward to open the outlet port 7.

Figure 5B:
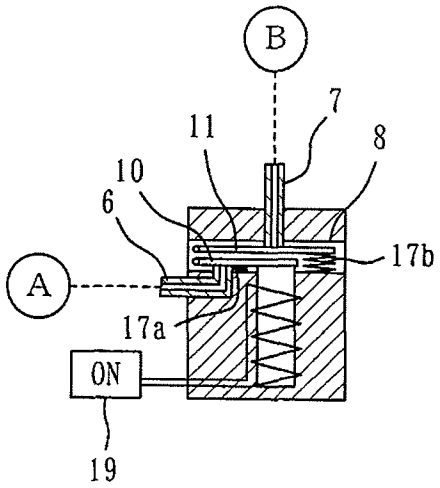
FIG. 5B is another longitudinal sectional view of the fluid supply control device of FIG. 5A, illustrating the fluid supply control device in operation.
Figure 5C:
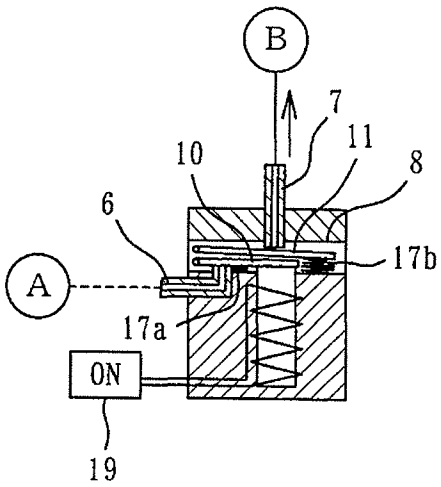
FIG. 5C is yet another longitudinal sectional view of the fluid supply control device of FIG. 5A, illustrating the fluid supply control device supplying a fluid.

According to the above configuration, to supply the fluid to the supply target B, the power supply device 19 is switched on to energize the electromagnetic coil 2, thereby exciting the electromagnetic coil 2. As shown in FIG. 5B, first, the first valve element 10 moves downward to close the inlet port 6 against the first spring 17*a* having the smaller spring load and stops the flowing of the fluid into the gauging chamber 8. Thereafter, as shown in FIG. 5C, the second valve element 11 moves downward against the second spring 17*b*. As a result, the fluid in the gauging chamber 8 moves upward and is sent out from the outlet port 7. Accordingly, while the outlet port 7 is opened, the first valve element 10 closes the inlet port 6, and as a result, the fluid does not flow into the gauging chamber 8 from the fluid supply source A. Therefore, the fluid charged in the gauging chamber 8 is accurately supplied to the supply target B with a certain amount.

When the supply of current to the electromagnetic coil 2 is shut off, the second valve element 11 is actuated by the second spring 17*b* having the larger spring load to close the outlet port 7, as shown in FIG. 5A. Thereafter, the first valve element 10 is actuated by the first spring 17*a* having the smaller spring load, such that the inlet port 6 is opened and the fluid from the fluid supply source A is supplied into the gauging chamber 8 through the inlet port 6. A certain amount of fluid is charged in the gauging chamber 8 and a next supply actuation is thus prepared.

Also in this exemplary embodiment, the time difference actuation of the first valve element 10 and the second valve element 11 can be achieved with a simple structure.

According to another exemplary embodiment, the first valve element 10 and the second valve element 11 are actuated with a time difference by attracting the first valve element 10 and the second valve element 11 by different electromagnetic coils.

Figure 6A:
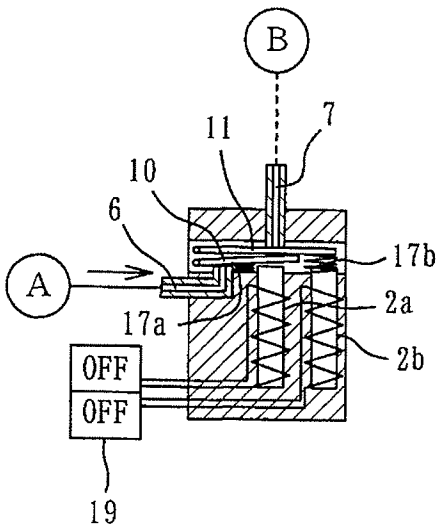
FIG. 6A is a longitudinal sectional view of a fluid supply control device according to another exemplary embodiment of the present invention, illustrating a standby condition of the fluid supply control device.

For example, as shown in FIG. 6A, a first electromagnetic coil 2*a* and a second electromagnetic coil 2*b* are connected to the power supply device 19, a plate-shape magnetic first valve element 10 is arranged above the electromagnetic coil 2*a*, and a plate-shape magnetic second valve element 11 is arranged above the electromagnetic coil 2*b*. The first valve element 10 and the second valve element 11 are vertically movable. One end of the first valve element 10 is pivotably supported on the device body 1 and the other end of the first valve element 10 is biased upward by the first spring 17*a*. One end of the second valve element 11 is pivotably supported on the device body 1 and the other end of the second valve element 11 is biased upward by the second spring 17*b*. The outlet port 7 is formed in the upper part of the device body 1 and the inlet port 6 is formed on the lateral side of the device body 1. The first valve element 10 moves upward to open the inlet port 6 and moves downward to close the inlet port 6. The second valve element 11 moves upward to close the outlet port 7 and moves downward to open the outlet port 7.

Figure 6B:
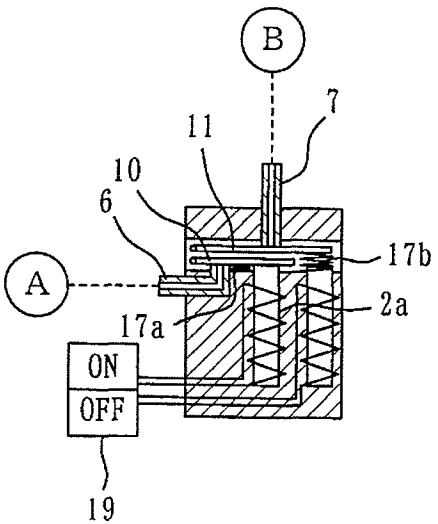
FIG. 6B is another longitudinal sectional view of the fluid supply control device of FIG. 6A, illustrating the fluid supply control device in operation.
Figure 6C:
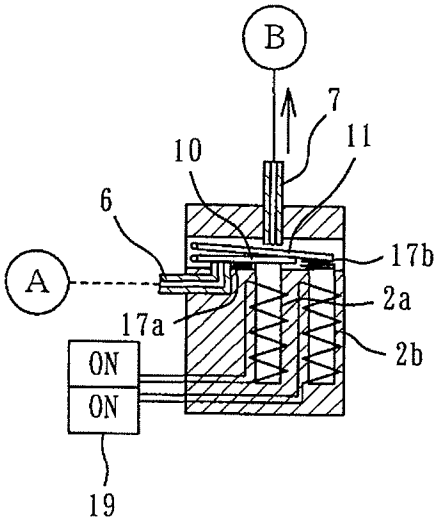
FIG. 6C is yet another longitudinal sectional view of the fluid supply control device of FIG. 6A, illustrating the fluid supply control device supplying a fluid.

In the above configuration, to supply the fluid the supply target B from the standby condition of FIG. 6A in which the fluid from the fluid supply source A is charged in the gauging chamber 8 through the inlet port 6, the first electromagnetic coil 2*a* is energized. As shown in FIG. 6B, by electromagnetic attraction force of the electromagnetic coil 2*a*, the first valve element 10 moves down to close the inlet port 6 against the spring force of the first spring 17*a* and stops the flowing of the fluid into the gauging chamber 8. Thereafter, as shown in FIG. 6C, when the second electromagnetic coil 2*b* is energized, the second valve element 11 moves downward against the spring force of the second spring 17*b* by the electromagnetic attraction force of the electromagnetic coil 2*b* to open the outlet port 7, and the fluid in the gauging chamber 8 is sent out through the outlet port 7. While the outlet port 7 is opened, the first valve element 10 closes the inlet port 6, and as a result, the fluid does not flow into the gauging chamber 8 from the fluid supply source A. Therefore, the fluid charged in the gauging chamber 8 is accurately supplied to the supply target B with a certain amount.

When the supply of current to the electromagnetic coil 2*b* is shut off, the second valve element 11 is actuated by the second spring 17*b* to close the outlet port 7. Thereafter, when the supply of current to the electromagnetic coil 2*a* is shut off, the first valve element 10 is actuated by the first spring 17*a*, such that the inlet port 6 is opened and the fluid from the fluid supply source A is supplied into the gauging chamber 8 through the inlet port 6. A certain amount of fluid is charged in the gauging chamber 8 and a next supply actuation is thus prepared.

Figure 7C:
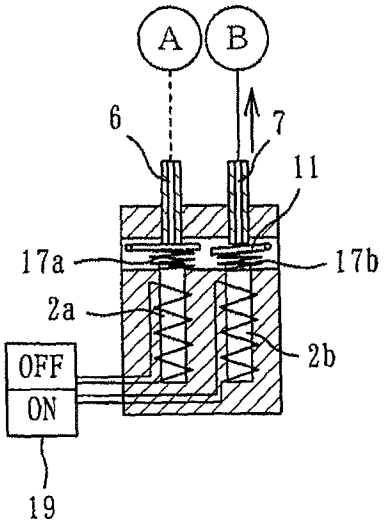
FIG. 7C is yet another longitudinal sectional view of the fluid supply control device of FIG. 7A, illustrating the fluid supply control device supplying a fluid.
Figure 7B:
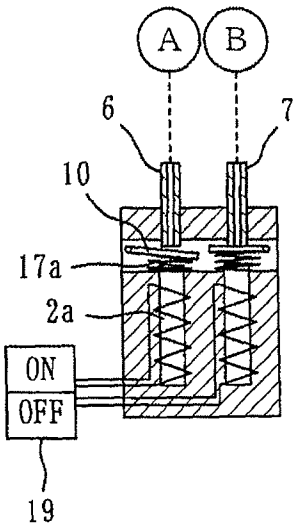
FIG. 7B is another longitudinal sectional view of the fluid supply control device of FIG. 7A, illustrating the fluid supply control device in operation.
Figure 7A:
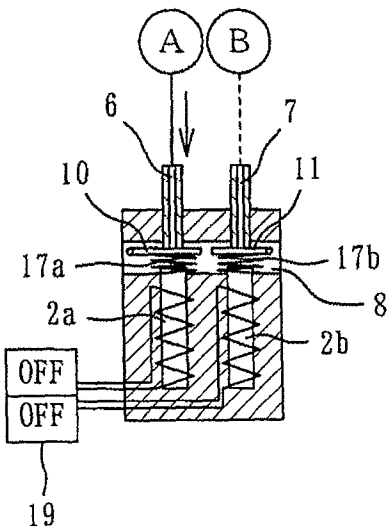
FIG. 7A is a longitudinal sectional view of a fluid supply control device according to another exemplary embodiment of the present invention, illustrating a standby condition of the fluid supply control device.

FIG. 7A shows another exemplary embodiment in which the first valve element 10 and the second valve element 11 are actuated with a time difference by attracting the first valve element 10 and the second valve element 11 using different electromagnetic coils. As shown in FIG. 7A, the first electromagnetic coil 2*a* and the second electromagnetic coil 2*b* are connected to the power supply device 19, the plate-shape magnetic first valve element 10 is arranged above the electromagnetic coil 2*a*, and the plate-shape magnetic second valve element 11 is arranged above the electromagnetic coil 2*b*. One end of the first valve element 10 is pivotably supported on the device body 1 and the other end of the first valve element 10 is biased upward by the first spring 17*a*. One end of the second valve element 11 is pivotably supported on the device body 1 and the other end of the second valve element 11 is biased upward by the second spring 17*b*. The spring force of the first spring 17*a* and the spring force of the second spring 17*b* may be the same. The electromagnetic force of the first electromagnetic coil 2*a* and the electromagnetic force of the second electromagnetic coil 2*b* may also be the same. The inlet port 6 and the outlet port 7 are formed in the upper part of the device body 1. The first valve element 10 moves upward to close the inlet port 6 and moves downward to open the inlet port 6. The second valve element 11 moves upward to close the outlet port 7 and moves downward to open the outlet port 7.

In the above configuration, to supply the fluid to the supply target B from the standby condition of FIG. 7A in which the inlet port 6 and the outlet port 7 are closed, only the electromagnetic coil 2*a* is energized first. As shown in FIG. 7B, by the electromagnetic attraction force of the electromagnetic coil 2*a*, the first valve element 10 moves downward to open the inlet port 6 against the spring force of the first spring 17*a* to charge the fluid into the gauging chamber 8. Thereafter, as shown in FIG. 7C, the supply of current to the electromagnetic coil 2*a* is shut off, and the electromagnetic coil 2*b* is energized. The second valve element 11 moves downward against the spring force of the second spring 17*b* by the electromagnetic attraction force of the electromagnetic coil 2*b* to open the outlet port 7, and the fluid in the gauging chamber 8 is sent out from the outlet port 7. While the outlet port 7 is opened, the first valve element 10 closes the inlet port 6, and as a result, the fluid does not flow into the gauging chamber 8 from the fluid supply source A. Therefore, the fluid charged in the gauging chamber 8 is accurately supplied to the supply target B with a certain amount.

When the supply of current to the electromagnetic coils 2*a* and 2*b* is shut off, the first valve element 10 and the second valve element 11 close the inlet port 6 and the outlet port 7 by the first spring 17*a* and the second spring 17*b*, and a next supplying actuation is prepared.

According to the exemplary embodiment shown in FIGS. 6A to 7C, the time difference actuation of the first valve element 10 and the second valve element 11 can be achieved only by an electrical timing control. Therefore, the time difference actuation can be performed accurately and reliably.

Figure 8C:
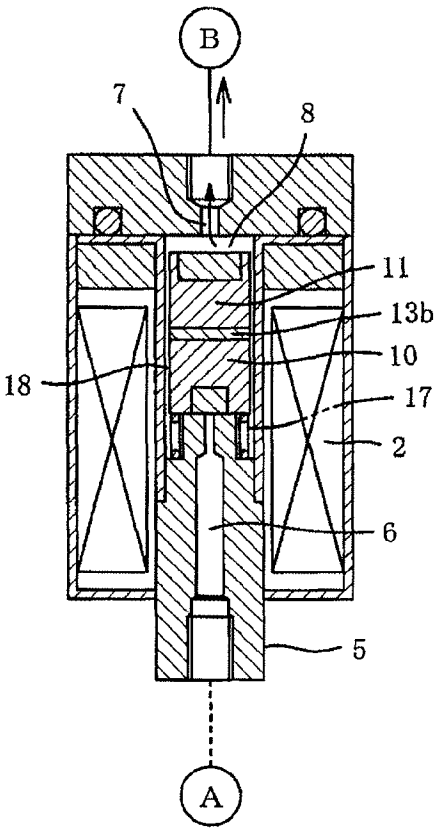
FIG. 8C is yet another longitudinal sectional view of the fluid supply control device of FIG. 8A, illustrating the fluid supply control device supplying a fluid.
Figure 8B:
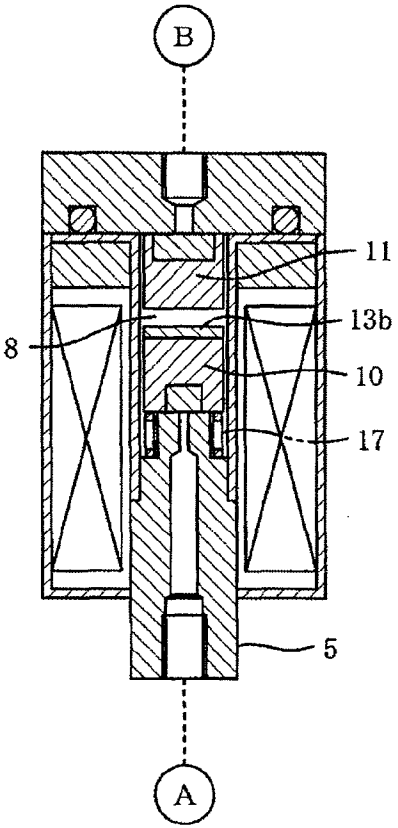
FIG. 8B is another longitudinal sectional view of the fluid supply control device of FIG. 8A, illustrating the fluid supply control device in operation.
Figure 8A:
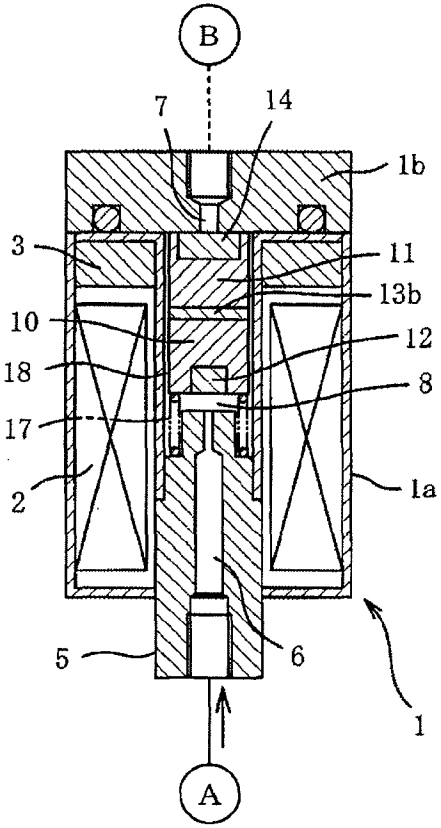
FIG. 8A is a longitudinal sectional view of a fluid supply control device according to another exemplary embodiment of the present invention, illustrating a standby condition of the fluid supply control device.

FIG. 8A shows another exemplary embodiment in which the position of the spring 17 is changed. In the exemplary embodiment shown in FIGS. 1A to 4C, the annular recess 16 is formed in the valve seat block 1*b* of the device body 1 and the spring 17 is disposed in the recess 16. In contrast, according to the exemplary embodiment of FIG. 8, the spring 17 is arranged between the upper end of the core 5 and the lower-end of the first assembly body 10. Specifically, the spring 17 is arranged between a shoulder portion of the core 5 formed around the inlet port 6 and the bottom surface of the first valve element 10. The first valve element 10 and the second valve element 11 are constantly biased by the spring 17 toward their top dead points.

According to the above configuration, in the standby condition, by the inflow pressure of the fluid sent into the gauging chamber 8 from the inlet port 6 at a constant pressure and the pressure of the spring 17, the first valve element 10 opens the inlet port 6 and the second valve element 11 closes the outlet port 7, as shown in FIG. 8A. Therefore, the fluid from the fluid supply source A is sent into the gauging chamber 8 through the inlet port 6 at a constant pressure, and a certain amount of fluid is charged in the gauging chamber 8.

To supply the fluid to the supply target B, the electromagnetic coil 2 is energized. By the electromagnetic force of the electromagnetic coil 2, the first valve element 10 moves downward against the spring force of the spring 17 to close the inlet port 6, as shown in FIG. 8B and thereafter, the second valve element 11 moves downward to open the outlet port 7, as shown in FIG. 8C. When the first valve element 10 closes the inlet port 6, the inflow of the fluid into the gauging chamber 8 is stopped. Thereafter, when the second valve element 11 opens the outlet port 7, the second valve element 11 lands on the upper end of the first valve element 10 via the intermediate member 13*b*. The fluid in the gauging chamber 8 moves upward through the longitudinal groove 18, and is sent out from the outlet port 7 to the supply target B in a vaporized state. Accordingly, while the outlet port 7 is opened, the first valve element 10 is closed, and as a result, the fluid does not flow into the gauging chamber 8 from the fluid supply source A. Therefore, the fluid charged in the gauging chamber 8 is accurately supplied to the supply target B with a certain amount.

When the supply of current to the electromagnetic coil 2 is shut off, the first valve element 10 and the second valve element 11 move upward by the spring 17, as shown in FIG. 8A, such that the second valve element 11 closes the outlet port 7. The first valve element 10 moves upward by the inflow pressure from the fluid supply source A, the inlet port 6 is opened, and the fluid from the fluid supply source A is supplied into the gauging chamber 8 through the inlet port 6. A certain amount of fluid is charged in the gauging chamber 8 and a next supply actuation is thus prepared.

As described above, this exemplary embodiment can also provide similar advantages as the other exemplary embodiments. Further, because this exemplary embodiment does not include the recess 16 of the exemplary embodiment FIGS. 1A to 4C, the overall height of the device body 1 can be reduced by an amount corresponding to the recess 16, and as a result, the entire device can be downsized.

Next, a gas combustion type nailer including the fluid supply control device described above will be described.

Figure 9:
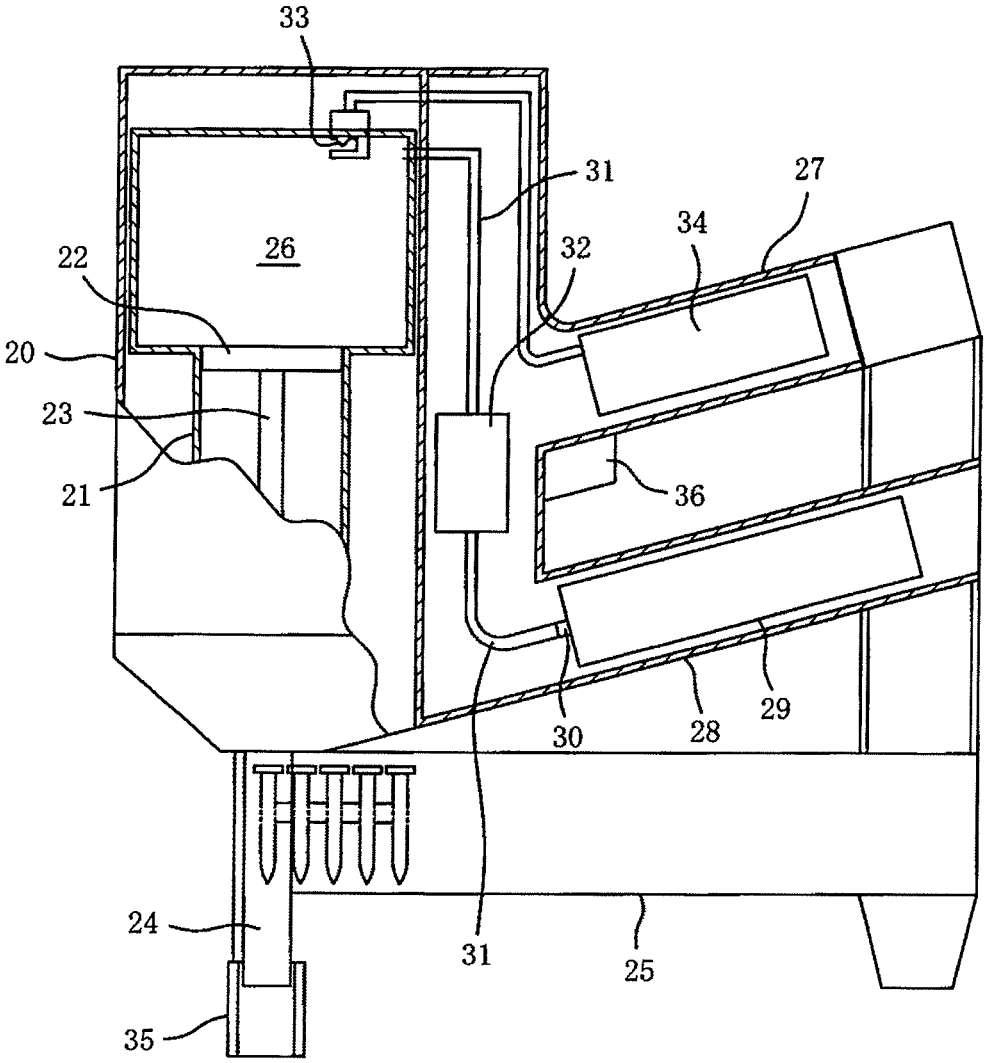
FIG. 9 is a longitudinal sectional view of a gas combustion type nailer having one of the fluid supply control devices of FIGS. 1A to 8A.

FIG. 9 is a longitudinal sectional view of a gas combustion type nailer including the fluid supply control device. The nailer has a striking mechanism in a body 20. The striking mechanism includes a cylinder 21, a piston 22 accommodated inside the cylinder 21 in a vertically slidable manner, and a driver 23 integrally coupled to the piston 22. A discharge nose portion 24 is formed below the body 20. The driver 23 is provided to be slidable in the nose portion 24. A magazine 25 is provided in the rear of the nose portion 24. A front end of the magazine 25 is opened to the nose portion 24 and nails in the magazine 25 are sequentially supplied into the nose portion 24 from the magazine 25.

A combustion chamber 26 is formed to be openable and closable in an upper part of the cylinder 21. Fuel gas is injected into the combustion chamber 26 and the injected fuel gas is ignited and exploded.

A gas can receiving portion 28 is provided between a grip 27 provided in the rear of the body 20 and the magazine 25. A gas can 29 charged with the fuel gas is accommodated in the gas can receiving portion 28. When a front nozzle 30 of the gas can 29 is received in the gas can receiving portion 28, the front nozzle 30 is connected to one end of a fuel pipeline 31 provided in the body 20. The other end of the fuel pipeline 31 is opened to the combustion chamber 26. A solenoid valve device 32 is provided in the middle of the fuel pipeline 31. An ignition plug 33 is attached to the combustion chamber 26. The ignition plug 33 is sparked by an ignition device 34 provided in the grip 27.

The ignition device 34 and the solenoid valve device 32 are actuated by pushing a contact arm 35 provided on the front end of the nose portion 24 onto the workpiece.

When striking a nail, first, the lower end of the contact arm 35 is pushed onto the workpiece, whereby the combustion chamber is closed and the solenoid valve device 32 is actuated, such that a certain amount of fuel gas is supplied from the gas can 29. The gas fuel is ejected into the combustion chamber from the ejection nozzle through the fuel pipeline 31, and is mixed with air.

Thereafter, by pulling a trigger 36, a circuit connected to the ignition plug 33 is switched on by the ignition device 34 and the mixed gas in the combustion chamber 26 is ignited. The mixed gas is combusted and explosively expanded. The pressure of the combustion gas acts on the top surface of the piston 22 to impulsively drive downward the piston 22, such that the piston 22 strikes the nail supplied in the nose portion 24 to strike the nail into the workpiece.

When the trigger 36 is released and the nose portion 24 is separated from the workpiece, the nailer is restored to the standby condition and the combustion chamber is opened to discharge the combustion gas to the atmosphere. A certain amount of fuel gas is supplied to the solenoid valve device 32 and a next striking is prepared.

The solenoid valve device 32 includes any one of the fluid supply control devices shown in FIGS. 1A to 8C, and controls the flow of the fuel gas so as to supply only a certain amount of fuel gas from the gas can 29.

That is, the solenoid valve device 32 includes a gauging chamber in which the fuel gas (fluid) of an amount to be supplied to the combustion chamber 26 per strike is charged from the fuel gas can 29, a first valve element closing the inlet port of the gauging chamber, and a second valve element closing the outlet port of the gauging chamber. The first valve element and the second valve element are actuated with a time difference by the electromagnetic force of the electromagnetic coil and the spring force. A certain amount of fuel gas is charged in the gauging chamber from the inlet port, and is supplied to the combustion chamber 26 from the outlet port of the gauging chamber.

According to the above configuration, the fuel gas is always supplied to the combustion chamber 26 by a certain amount. Therefore, insufficient striking of nails is prevented, thereby enabling a stable striking of the nails.

When a fluid supply control device according to one of the exemplary embodiments shown in FIGS. 1A to 6A and FIGS. 8A to 8C is used as the solenoid valve device 32, the fuel gas for one strike is charged in the gauging chamber 8 of the solenoid valve device 32 in the standby condition. Therefore, when the contact arm 35 is pressed and the trigger 35 is pulled after removing the gas can from the nailer, the fuel gas for one strike remaining in the solenoid valve device 32 is still supplied to the combustion chamber and ignited. In the manner, a nail may be erroneously discharged.

Figure 10:
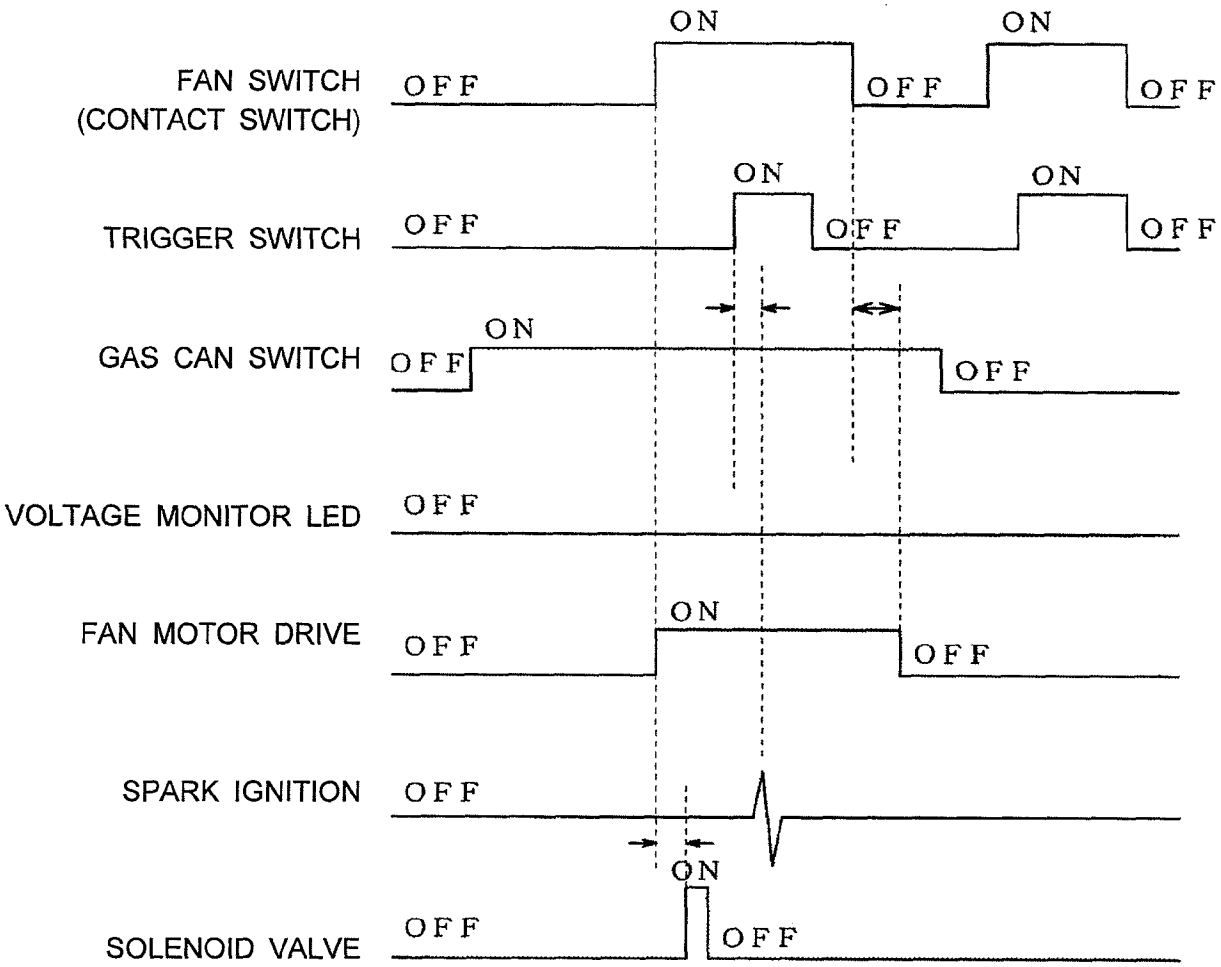
FIG. 10 is a timing chart illustrating operations for preventing a nailer from being actuated without a fuel gas being mounted.

Therefore, as shown in FIG. 10, a sensor switch that senses whether or not the gas can is present is provided in the gas combustion type nailer and when the sensor switch is in an off state, the gas combustion type nailer may be configured to prevent the ignition of the gas in the combustion chamber. When the sensor switch is in the off state, a fan motor may also be prevented from being driven.

According to the above configuration, when the gas can is mounted, the sensor switch is turned on. As a result, when a fan switch is turned on by pushing the contact arm onto the workpiece, the fan motor is driven and the solenoid valve of the solenoid valve device is opened to supply the fuel gas into the combustion chamber and agitated by a fan. Thereafter, by pulling the trigger, the mixed gas in the combustion chamber is ignited by an igniter discharge to actuate the nailer. In contrast, when the gas can is not mounted, the sensor switch is turned off. Therefore, even if the fan switch is turned on by pushing the contact arm onto the workpiece, the fan motor is not driven and a spark by the igniter discharge is not generated. Even if the trigger is pulled, the mixed gas in the combustion gas is not combusted, and thus, the nailer is not actuated. When the contact arm is moved away from the workpiece, the fan switch is tuned off and the combustion chamber is opened, so that the internal mixed gas is discharged to the atmosphere. Accordingly, it is possible to prevent a nail from being erroneously discharged by the fuel gas remaining in the solenoid valve device 32.

What is claimed is:

1. A fluid supply control device comprising:

a gauging chamber configured to be charged with a fluid from a fluid supply source;

an inlet port through which the fluid flows into the gauging chamber;

an outlet port through which the fluid flows out from the gauging chamber;

a first valve element arranged inside the gauging chamber to close the inlet port;

a second valve element arranged inside the gauging chamber to close the outlet port;

an electromagnetic biasing structure configured to electromagnetically bias the first valve element to move the first valve element and to electromagnetically bias the second valve element to move the second valve element; and an elastic biasing structure configured to elastically bias at least one of the first valve element and the second valve element, wherein the elastic biasing structure is configured to elastically bias only one of the first valve element and the second valve element, and wherein the first valve element and the second valve element are configured and arranged such that the first valve element and the second valve element are independently movable and are actuated with a time difference.

2. The fluid supply control device according to claim 1, wherein the first valve element closes the inlet port before the second valve element opens the outlet port, and maintains the inlet port closed while the second valve element maintains the outlet port open.

3. The fluid supply control device according to claim 1, wherein the second valve element closes the outlet port before the first valve element opens the inlet port and, maintains the outlet port closed while the first valve element maintains the inlet port open.

4. The fluid supply control device according to claim 1, wherein the first valve element receives an inflow pressure from the fluid flowing in from the inlet port to open the inlet port, wherein the second valve element receives an elastic force from the elastic biasing structure and a pressure from the inflow pressure to close the outlet port, wherein the first valve element receives an electromagnetic force from the electromagnetic biasing structure to close the inlet port against the inflow pressure, and wherein the second valve element receives the electromagnetic force from the electromagnetic biasing structure to open the outlet port against the elastic force and the inflow pressure.

5. The fluid supply control device according to claim 1, wherein the electromagnetic biasing structure comprises a single electromagnetic coil, and wherein the first valve element and the second valve element are configured and arranged such that an intensity of the electromagnetic force of the electromagnetic coil that acts on the first valve element is different from an intensity of the electromagnetic force of the electromagnetic coil that acts on the second valve element.

6. The fluid supply control device according to claim 5, wherein a distance between the electromagnetic coil and the first valve element is different from a distance between the electromagnetic coil and the second valve element.

7. The fluid supply control device according to claim 6, further comprising a spacer made of a nonmagnetic material, wherein the spacer is arranged between the first valve element and the second valve element.

8. The fluid supply control device according to claim 5, wherein the magnetic permeability of the first valve element is different from the magnetic permeability of the second valve element.

9. The fluid supply control device according to claim 5, wherein the first valve element and the second valve element are arranged on a common axis and are movable along the common axis.

10. The fluid supply control device according to claim 5, wherein the elastic biasing structure comprises a single spring, and wherein the spring biases the second valve element in a direction in which the second valve element closes the outlet port.

11. The fluid supply control device according to claim 10, wherein the spring is provided between the first valve element and a shoulder portion provided around the inlet port, and wherein the spring biases the first valve element in a direction in which the first valve element opens the inlet port.

12. The fluid supply control device according to claim 1, wherein the electromagnetic biasing structure comprises a first electromagnetic coil configured to attract the first valve element, and a second electromagnetic coil configured to attract the second valve element.

13. A gas combustion type nailer, comprising:

a fluid supply control device;

a combustion chamber to which fuel gas from a fuel gas can is supplied through the fluid supply control device; and a striking mechanism driven by a combustion of the fuel gas in the combustion chamber, wherein the fluid supply control device comprises:

a gauging chamber configured to be charged with the fuel gas from the fuel gas can;

an inlet port through which the fuel gas flows into the gauging chamber;

an outlet port through which the fuel gas flows out from the gauging chamber;

a first valve element arranged inside the gauging chamber to close the inlet port;

a second valve element arranged inside the gauging chamber to close the outlet port;

an electromagnetic biasing structure configured to electromagnetically bias the first valve element to move the first valve element and to electromagnetically bias the second valve element to move the second valve element; and an elastic biasing structure configured to elastically bias at least one of the first valve element and the second valve element, wherein the elastic biasing structure is configured to elastically bias only one of the first valve element and the second valve element, wherein the first valve element and the second valve element are configured and arranged such that the first valve element and the second valve element are independently movable and are actuated with a time difference.

* * * * *